US006933771B2

(12) United States Patent
Stearns et al.

(10) Patent No.: US 6,933,771 B2
(45) Date of Patent: Aug. 23, 2005

(54) OPTICALLY GENERATED ISOLATED FEEDBACK STABILIZED BIAS

(76) Inventors: Stanley D. Stearns, P.O. Box 55603, Houston, TX (US) 77255; Chris S. Cowles, P.O. Box 55603, Houston, TX (US) 77255

( * ) Notice: Subject to any disclaimer, the term of this patent is extended or adjusted under 35 U.S.C. 154(b) by 145 days.

(21) Appl. No.: 10/619,852

(22) Filed: Jul. 15, 2003

(65) Prior Publication Data

US 2005/0012543 A1 Jan. 20, 2005

(51) Int. Cl.[7] ..... G05F 1/10
(52) U.S. Cl. ..... 327/540; 327/514
(58) Field of Search ..... 327/514, 515, 327/530, 534, 535, 540, 560, 561, 563

(56) References Cited

U.S. PATENT DOCUMENTS

| | | | | |
|---|---|---|---|---|
| 3,975,649 A | | 8/1976 | Kawagoe et al. | |
| 4,375,596 A | | 3/1983 | Hoshi | |
| 4,380,706 A | | 4/1983 | Wrathall | |
| 4,471,290 A | | 9/1984 | Yamaguchi | |
| 4,794,247 A | | 12/1988 | Stineman, Jr. | |
| 4,843,265 A | | 6/1989 | Jiang | |
| 5,262,989 A | | 11/1993 | Lee et al. | |
| 5,517,154 A | * | 5/1996 | Baker et al. | 330/59 |
| 5,541,519 A | | 7/1996 | Stearns et al. | |
| 5,594,346 A | | 1/1997 | Stearns et al. | |
| 5,767,683 A | | 6/1998 | Stearns et al. | |
| 5,805,062 A | | 9/1998 | Pearlman | |

* cited by examiner

*Primary Examiner*—Jeffrey Zweizig
(74) *Attorney, Agent, or Firm*—James E. Hudson, III; Kenneth A. Keeling; Keeling Hudson, L.L.C.

(57) ABSTRACT

The present invention provides a bias generation circuit in which the voltage of electrically isolated circuits are stabilized by providing a photovoltaic diode in each circuit, a common light source uniformly positioned to provide equivalent energy to each photovoltaic diode and an operational amplifier, configured with a capacitor as an integration circuit, driving the common light source, wherein one isolated circuit provides feedback to the amplifier, such that variations in the voltage in the isolated circuit causes the amplifier to provide an adjusted signal to the common light source, adjusting the energy output to compensate for voltage variations simultaneously, yet independently occurring in each isolated photovoltaic diode circuit. Such bias voltage circuit may be used with chromatographic ionization detectors as well other devices.

24 Claims, 4 Drawing Sheets

OPTICALLY GENERATED ISOLATED FEEDBACK STABILIZED BIAS

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

The invention is generally related to electrical bias voltage generation and more specifically to the optical generation of an adjustable, stable, low-noise, electronically isolated bias for use with precision analytical equipment.

2. Description of the Related Art

The generation of bias voltages is widely known in the field of analytical chemistry. Equipment used to detect very small levels of charge use a bias voltage to produce an accelerating field in ion detectors, such as chromatographic ionization detectors.

A chromatographic ionization detector operates by applying a high voltage across discharge electrodes that are located in a gas-filled source chamber. In the presence of a detector gas such as helium, a characteristic discharge emission of photons occurs. The photons irradiate an ionization chamber receiving a sample gas that contains an analyte of interest. Ions are produced in the ionization chamber as a result of photon interaction with ionizable molecules in the sample gas. Such detectors are well known in the art and include U.S. Pat. No. 5,767,683 issued Jun. 16, 1998 to Stearns, Cai and Wentworth, U.S. Pat. No. 5,594,346 issued Jan. 14, 1997 to Stearns and Wentworth, and U.S. Pat. No. 5,541,519 issued Jul. 30, 1996 to Stearns and Wentworth.

The sensitivity and resolution of detection equipment may be limited by the stability of the bias voltage and the extraneous electrical variations, or noise, created by associated electrical circuits. Voltage variations in the bias and/or leakage currents produced by the bias may mask the desired occurrences to be measured.

Simple bias voltage may be generated from a 12 V DC power supply. Transistors and integrated circuit converters are used to modify the frequency and voltage of the current from the power supply to obtain a desired bias. Further transistorized circuitry may be used to filter and monitor the current and voltage in order to achieve a useable degree of stability.

Bias generation in the prior art has typically involved the use of transformer-coupled circuits in which a first transformer, driven by an alternating-current source, is connected to a second transformer whose isolated output is then rectified, filtered, and regulated at a predetermined voltage by additional circuitry. Disadvantage of this scheme include: the output bias voltage is not adjustable without additional feedback circuitry; variations in the output bias voltage are not sensed and regulated without additional feedback circuitry; AC electromagnetic fields may be coupled to the detecting circuitry, causing instability in the measurement process without additional shielding; and the number of components required may increase the cost and reduce the reliability of the employing device.

Diodes are known to be able to produce light when a current is passed through, or to generate a current when excited by a light source. In both cases, the intensity of the light is proportional to the magnitude of the current.

Incident with a current flow through a diode is a voltage drop across the diode. The relationship between the current and the voltage is given by the well-known diode equation:

$$I_D = I_S\, e^{K(T-T0)}\, [e^{V/\lambda Vt} - 1]$$

where $I_S$ is the saturation current, fixed by the materials and fabrication of the diode (amps);

K is a constant for the material used for the diode, approximately 0.045 for silicon;

T is the diode temperature (°K);

$T_0$ is the diode reference temperature (°K);

$V_t$ is the threshold voltage, 0.026 volts (V);

V is the voltage through the diode (V);

e is the electron charge ($1.602\times10^{-19}$C);

K is Boltzmann's Constant ($1.380\times10^{-23}$ J/K); and

λ is a constant for the material used for the diode, approximately 2 for silicon.

Of importance is that diode current and voltage drop are not linearly proportional and are influenced by temperature. For illustration of the influence of temperature, where $I_S$=1.0E−9 amperes, $T-T_0$=0 and V=0.036 volts, then $I_D$=1.0E−9 amperes; in the same example where V=0.36 volts, then $I_D$=1.0E−6 amperes. If at V=0.36 Volts, diode temperature, T, rises such that $T-T_0$=10° C., then $I_D$=1.57E−6 amperes.

In a practical photovoltaic diode circuit, some type of device or load will be externally connected to the photovoltaic diode. When the effect of such a load is added to the diode equation the equation becomes:

$$I_D = I_S e^{K(T-To)}[e^{V/\lambda Vt} - 1] + V/R_L$$

where $I_D$ is the total generated current and $R_L$ is the value of the load, in ohms.

Anomalies in a power supply and environmental conditions, such as temperature and humidity affect the electrical current produced by an electrical circuit. The voltage supplied to the load is subject to such anomalies. A practical photovoltaic diode circuit requires some means of control and stabilization of the generated voltage. Some examples of prior art circuits designed to compensate for voltage variations in circuits include:

U.S. Pat. No. 4,375,596, issued on Mar. 1, 1983, to Hoshi, discloses a reference voltage generator circuit, which overcomes variations in a power supply by dividing the power supply voltage to create two output signals, uniformly modifying the signals in opposite polarity, then averaging the resulting signals to generate a constant value of reference voltage.

U.S. Pat. No. 4,380,706, issued on Apr. 19, 1983, to Wrathall, discloses a temperature stable voltage reference source, which uses a differential amplifier with an output coupled to an additional amplifying stage, involving two bipolar transistors, wherein the emitter of one transistor is larger than the emitter of the other transistor. Cascaded emitter followers are used between the two amplifying stages to develop a higher voltage, which is fed back into the inputs of the differential amplifier, thereby establishing a more independently stable reference voltage circuit.

U.S. Pat. No. 4,471,290, issued on Sep. 11, 1984, to Yamaguchi, discloses a substrate bias generating circuit responsive to the output signal of the oscillator circuit, which includes a voltage divider connected between the output terminal of the bias generating circuit and a ground terminal, and a level sensor for producing a control signal to the oscillator circuit when it is detected that the output voltage of the voltage divider reaches a predetermined value, to thereby stop the oscillating operation of the oscillator circuit.

U.S. Pat. No. 5,262,989, issued on Nov. 16, 1993, to Lee et al., discloses a circuit for sensing back-bias levels in a semiconductor device that causes the voltage pump circuit to adjust output to reach and maintain a desired voltage level.

U.S. Pat. No. 3,975,649, issued on Aug. 17, 1976, to Kawagoe et al., discloses a temperature compensation circuit that uses a high value resistor and at least one field-effect transistor for connection between a circuit to be compensated and the power source, such that the when ambient temperature of the circuit increases the current flowing through the field-effect transistor decreases. However, the decreased current from the field-effect transistor causes voltage drop across the resistor to decrease. With the opposite end of the resistor connected to the gate of the field-effect transistor, the relative increase in voltage causes an increased current flow through the field-effect transistor, compensating for the temperature fluctuation to stabilize the output voltage.

U.S. Pat. No. 4,794,247, issued on Dec. 27, 1988, to Stineman, Jr., discloses using an integrating amplifier with a feedback capacitor, to stabilize the bias signal from a photovoltaic detector, while reducing the noise effect.

U.S. Pat. No. 4,843,265, issued on Jun. 27, 1989, to Jiang, discloses a temperature compensating circuit that generates inverse variations in a field-effect transistor, achieved by charging a capacitor to a voltage and discharging the capacitor through a field-effect transistor in response to the fluctuations.

Also known to the field of art is the use of photovoltaic diodes to produce a current isolated from the current of the light source. Light sources capable of exciting current in photovoltaic diodes include light-emitting diodes. Prior art that demonstrates these uses include:

U.S. Pat. No. 5,805,062, issued on Sep. 8, 1998, to Pearlman, discloses an isolation amplifier that transmits data to a receiver via a current loop, where the isolated portion of the circuit is powered by a photovoltaic array illuminated by a light source, optionally an array of same frequencied light-emitting diodes.

A device is commercially available, referred to as an optically coupled floating power source, that is composed of one or more light-emitting diodes and one or more photovoltaic diodes, disposed within an opaque package in such a way that light from the light-emitting diodes impinge on the photovoltaic diodes, thereby generating a current in the photovoltaic diodes in response to the current supplied to the light-emitting diodes.

It would be an improvement to the field to create a bias voltage from a power source comprises of at least one light-emitting diode stimulating matched currents in at least two electrically isolated photovoltaic diodes, such that the circuit of one diode is used to provide a feedback voltage to an operational amplifier driving the light-emitting diode, thereby stabilizing the output voltage in both of the photovoltaic diode circuits.

It would be a further improvement to provide a distance between the bias source and detector due to the temperature of the detector. Such distance however typically requires shielding of the connection between the electronics and the detector, typically by coaxial cabling. The use of such shielding introduces capacitance which creates a pathway into the electronics for current noise resulting from the voltage noise in the bias generator. Low noise in the bias generator therefore becomes more critical under these circumstances.

BRIEF SUMMARY OF THE INVENTION

Accordingly, the objects of this invention is to provide, inter alia, an electrical circuit for generating a bias voltage that:

- provides sufficient voltage stability for highly precise analytical measuring equipment, including chromatographic ionization detectors has low noise production;
- has the output circuit electrically separated from the drive and feedback circuit;
- provides a stabilizing feedback voltage to a drive amplifier; and
- provides the ability to set and vary the generated voltage of the circuit.

Other objects of my invention will become evident throughout the reading of this application.

The current invention is an electrical circuit for detection equipment, such as chromatographic ionization detectors, for the generation of a stable, low-noise bias, having at least one set of one or more light-emitting diodes (LED) and at least two photovoltaic diode sets disposed in such a way that light from each light-emitting diode impinges on at least two photovoltaic diode sets, thereby generating a current in the photovoltaic diode sets in response to current supplied to the light-emitting diode. The photovoltaic diode set may include two or more photovoltaic diodes. The current from one photovoltaic diode set produces the output voltage, while the current of the other photovoltaic diode set feeds into an amplifier, which regulates the drive current to the light-emitting diode set. Fluctuations in the current produced in the photovoltaic diode set in the output circuit are identically, though independently, represented in the other photovoltaic diode, which in turn causes a corresponding adjustment in the drive current to the light-emitting diode to correct the fluctuation. The result is an essentially stable output voltage. (The term "essentially", as used herein, means closely approximating to a degree sufficient for practical purposes.)

DESCRIPTION OF THE INVENTION

Figure 1:
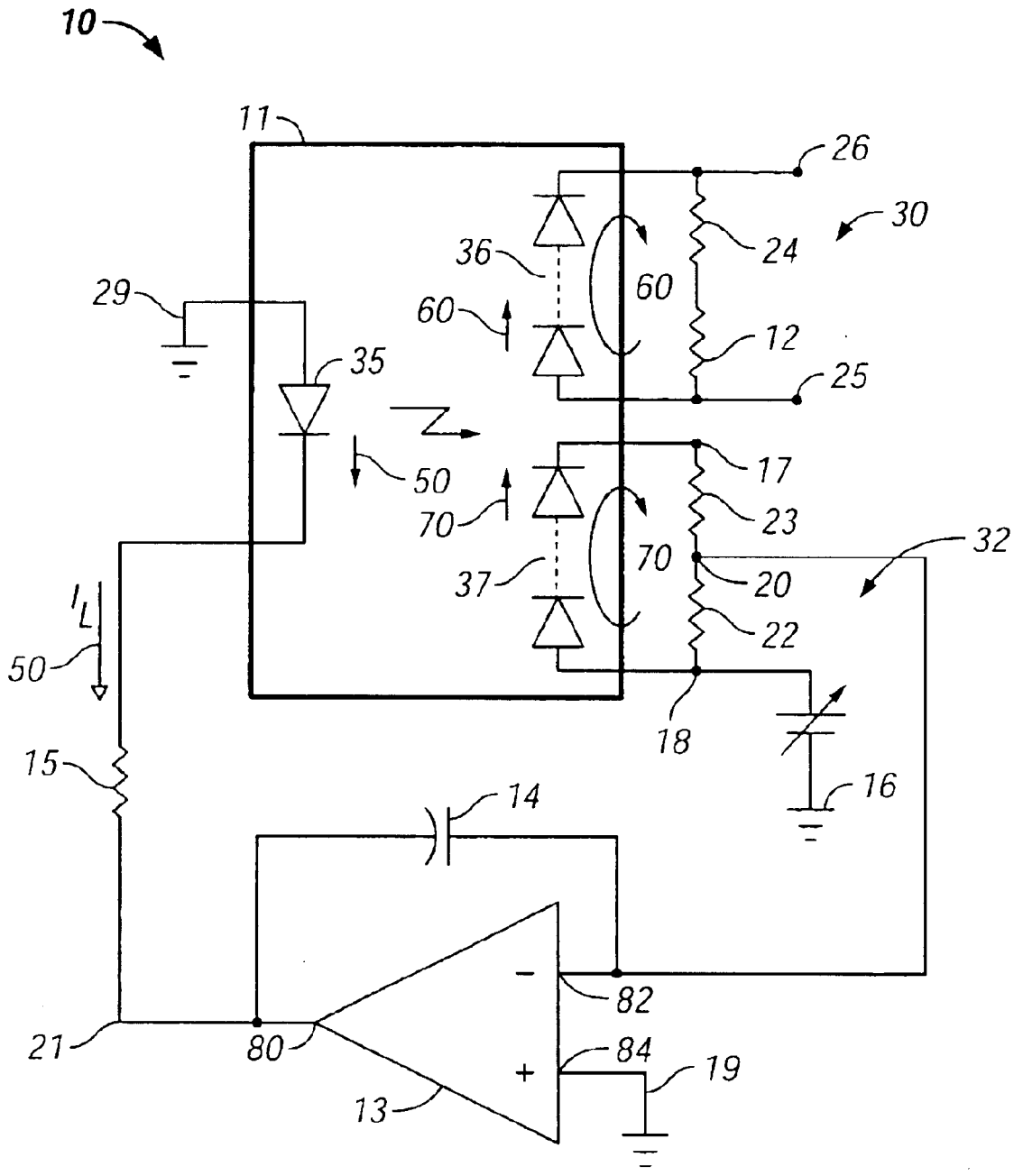
FIG. 1 is a simplified schematic of a bias generation circuit in accordance with the present invention.

Referring to FIG. 1, the present invention provide a bias generation circuit 10 in which an optically coupled power source 11 generates identical currents within electrically isolated circuits. Optically coupled power source 11 comprises light emitting diode 35, connected to ground 29 at its anode end and to resistor 15, then on to output 80 of operational amplifier 13 on its cathode end. Light emitting diode 35 is disposed in such a way that the light from light emitting diode 35 impinges equally on controlled photovoltaic diode set 36 and controlling photovoltaic diode set 37. Controlled photovoltaic diode set 36 and controlling photovoltaic diode set 37 thereby respectively generate essentially equivalent, electrically isolated controlled current 60 and controlling current 70. In the preferred embodiment, optically coupled power source 11 is a commercially available circuit chip, DIG-12-8-30, by Dionics, Inc.

Controlled photovoltaic diode set 36 is connected into controlled circuit 30. Output node 25 connects to the anode end of controlled photovoltaic diode set 36 and input node 26 connects to the cathode end of controlled photovoltaic diode set 36. Also connected between input node 26 and output node 25, parallel with controlled photovoltaic diode set 36 are resistors 24 and 12. In the exemplary embodiment, resistor paris 24 and 12, and 22 and 23, posses equivalent resistance.

Controlling photovoltaic diode set 37 is connected into controlling circuit 32. Positive output node 18 connects to the anode end of controlling photovoltaic diode set 37. Positive output node 18 is also connected to a reference voltage source 16, which is adjustable. In the exemplary embodiment, reference voltage source 16 is set to +10 volts. Node 17 connects to the cathode end of controlling photovoltaic diode set 37. Node 17 also connects to resistor 23, which in turn connects to node 20. Resistor 22 connects to node 20 on one end and to node 18 on the other. Resistors 23 and resistor 22 possess equivalent resistance.

Non-inverting input 84 of operational amplifier 13 is connected to ground 19. Inverting input 82 of operational amplifier 13 is connected to node 20 and to one side of capacitor 14. Output 80 of operational amplifier 13 is connected to resistor 15 and the other side of capacitor 14.

Referring to FIG. 1, operational amplifier 13, well known to those skilled in the art, produces an output voltage proportional to the difference between the voltages at the input nodes as:

$$V_0 = A\ (V^+ - V^-)$$

where $V_0$ is the output voltage, $V^+$ is the non-inverting input node voltage, $V^-$ is the inverting input node voltage, and A is the gain factor, usually on the order of $10^6$. Under conditions of stable operation, the magnitude of $V_0$ will be less than a few volts (e.g., <10 volts), and the input voltage difference, $V^+ - V^-$, will therefore be less than $V_0/A$ (e.g., <10 micro-volts). For practical purposes, the input voltage difference may then be considered to be zero.

Introducing drive current 50, through light emitting diodes 35, activates circuit 10. The light emitted by light emitting diodes 35, induces driven output current 60 and driven feedback current 70.

Under stable operating conditions, equal currents 60 and 70 are produced by photovoltaic diode sets 36 and 37, respectively, the voltage across resistor 12 and 24, is equal to the voltage across resistors 22 and 23, the voltage at node 17, is equal in magnitude and opposite in sign to the voltage at node 18, and the voltage at node 20, (since the resistors 22 and 23, are of equal value) is essentially zero. The electrically isolated voltage source at nodes 25 and 26 is used as the desired stable generated bias.

Figure 5:
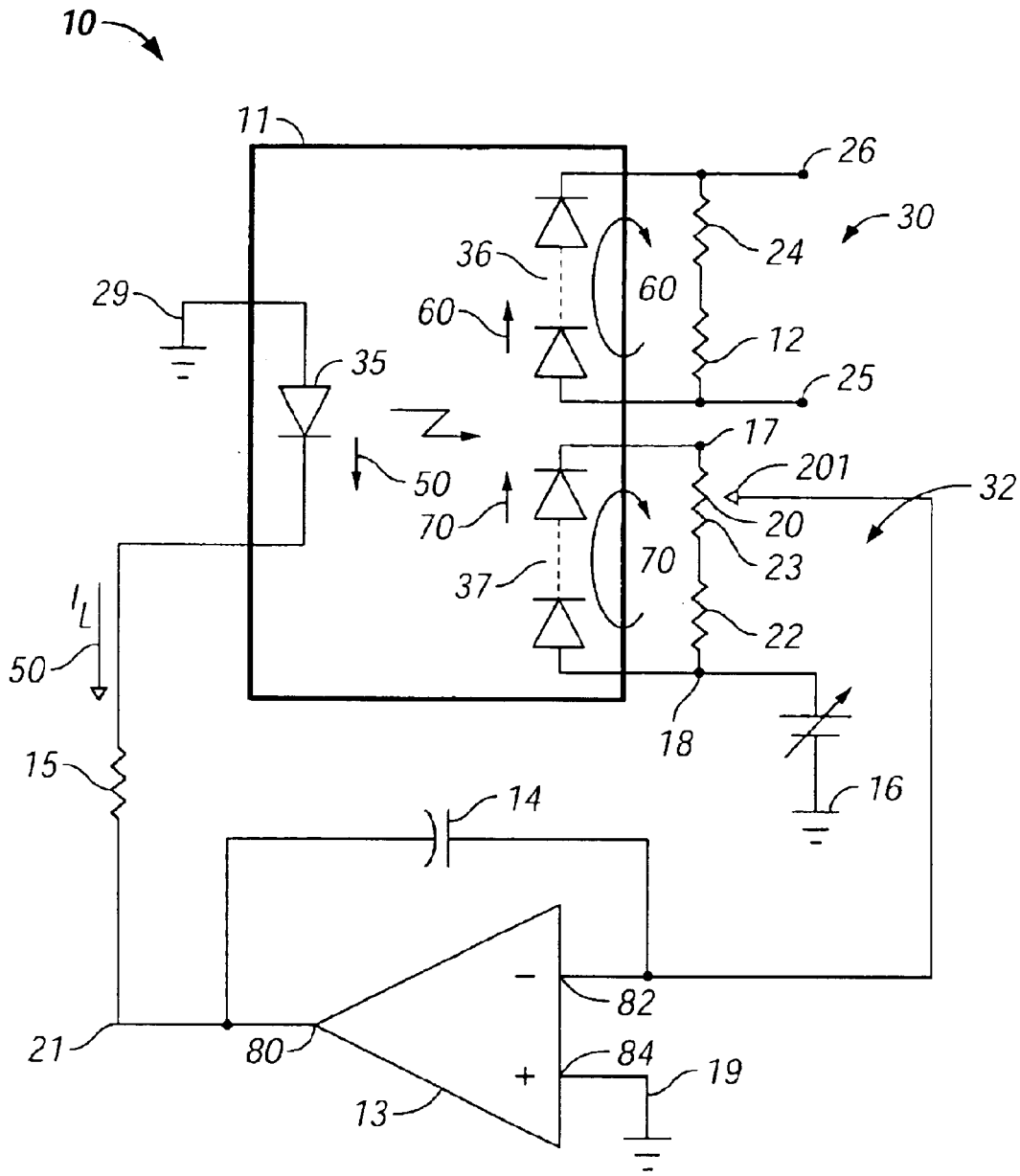
FIG. 5 is a simplified schematic of a bias generation circuit in accordance with the present invention having a potentiometer for equalization of current output from the two photovoltaic diode sets to correct for any differences in output of the two photovoltaic diode sets.

The equality of current 60 and 70 contains natural variations, possibly due to non-uniform transmission of light energy simultaneously to diode 36 and 37 from diode 35, the physical characteristics of diodes 36 and 37 not being completely identical, or other variation sources. In the exemplary embodiment shown in FIG. 5 these variations are adjusted by inserting the adjustable contact of potentiometer 210 to node 20, between resistors 22 and 23, which alters the ratios of values of resistors 22 and 23 while keeping the sum of their values constant. The total resistance through the potentiometer 201 at node 20, and resistors 22 and 23 would equal the total resistance through resistors 12 and 24. Alternatively, the ratio of resistors 22 and 23 could be left constant and the configuration of resistors 12 and 24 could be altered to adjust the sum of resistors 12 and 24, in order to correct the imbalances as they occurred. As a further alternative, potentiometer 201 could be replaced with a resistor of resistance equal to potentiometer 201 (not shown) Other equivalent solutions are know to the field, which may be employed to manipulate the ratio and sum of the resistance values between nodes 17 and 18 with the resistance values between nodes 25 and 26.

Referring to FIG. 1, bias generation circuit 10 is configured to seek a stable condition. Since both photovoltaic diode pairs 36 and 37 are subject to the same conditions of loading—illumination, temperature, etc.—the voltage difference between nodes 25 and 26 will be the same as the voltage difference between nodes 18 and 17. Although the voltage at node 18 is set by reference source 16 to be +10 volts in the following examples, the condition for stability is not dependent on the magnitude of that voltage, within the operational limits of the circuit.

Example One: Stability

Assume that resistors 12, 22, 23 and 24, have equal value of $1.0\times10^6$ ohms (1.0 M ohms); the amplifier gain A, is $1.0\times10^6$; the voltage at node 18, set by reference source 16, is +10 volts; the current generated by the photovoltaic diodes is 10 microamperes; the voltage at node 17 is −10 volts; the voltage difference between nodes 25 and 26 is 20 volts; and the voltage at node 21 is −5 volts. The voltage at node 20 is then $+5\times10^{-6}$ volts, essentially zero for practical purposes. Since the current through resistor 22 into node 20 is equal to the current through resistor 23 out of node 20, no net current flows into (out of) inverting input 82 of amplifier 13, or through capacitor 14, via node 20. Since no current flows through capacitor 14 the voltage across capacitor 14 does not change and driving current 50 through resistor 15 does not change.

Example Two: Variation Correction

Assume that an instantaneous variation in ambient conditions, e.g., temperature, occurs such that the voltage drop across resistors 22 and 23 (and thereby across resistors 12 and 24) is reduced by 1.0 volt. Since the voltage at node 18 is fixed at +10 volts by reference source 16, and the voltage at node 20 is essentially zero, the voltage at node 17 will thereby be −9 volts. The current through resistor 22, into node 20, will still be 10 microamperes; the current through resistor 23, out of node 20, will be 9 microamperes, and the net current into node 20, through capacitor 14, will thereby be 1 microampere. Since the voltage across a capacitor is proportional the integral of the current through it as:

$$V = (1/C)\int i\ dt$$

the voltage across capacitor 14, will begin to change at a rate that satisfies the relation:

$$i = C\ dV/dt$$

where i is the current flowing through the capacitor, C, is the capacitance in Farads, and V is the voltage across the capacitor. (E.g., let the capacitance, C, be $1\times10^{-6}$ farad and the current be 1 microampere, as above. The voltage across the capacitor 14 will then instantaneously begin to increase at the rate of 1 volt/second.) As the voltage across capacitor 14 increases, the voltage at node 21 becomes increasingly more negative and the driving current 50 increases until a new stable condition exists, such that driving current 50 is of a magnitude to sustain the conditions assumed above in Example One.

Figure 2:
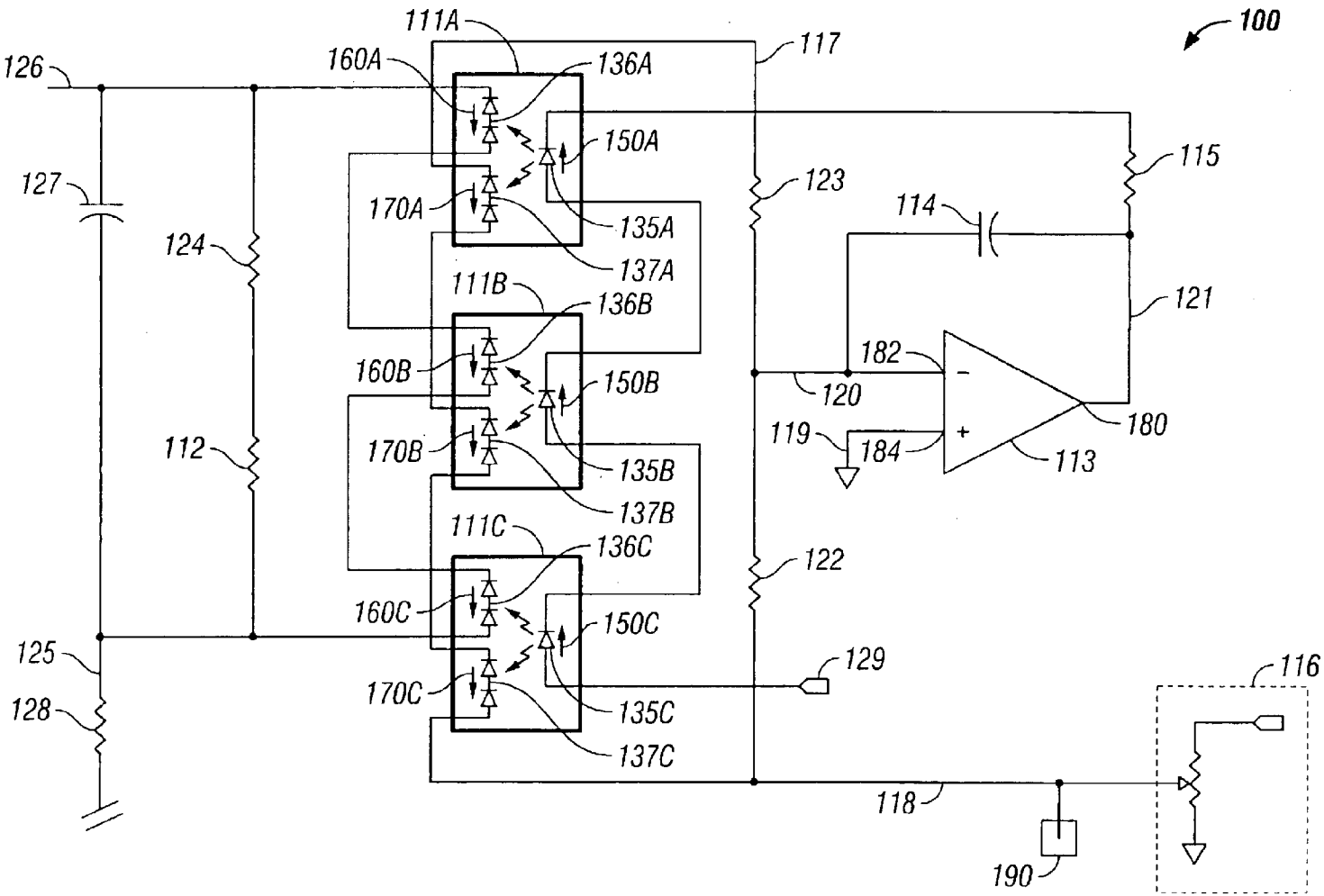
FIG. 2 is a simplified schematic of a bias generation circuit in accordance with the present invention, having multiple light-emitting diodes in series.

FIG. 2 depicts an alternate exemplary embodiment wherein bias generation circuit 100 comprises multiple optically coupled power sources 111A, 111B and 111C, connected in series. Such configuration provides the potential to develop greater levels of voltage across output node 125 and input node 126 than would be generated by a single similar optically coupled power source (not shown).

Figure 3:
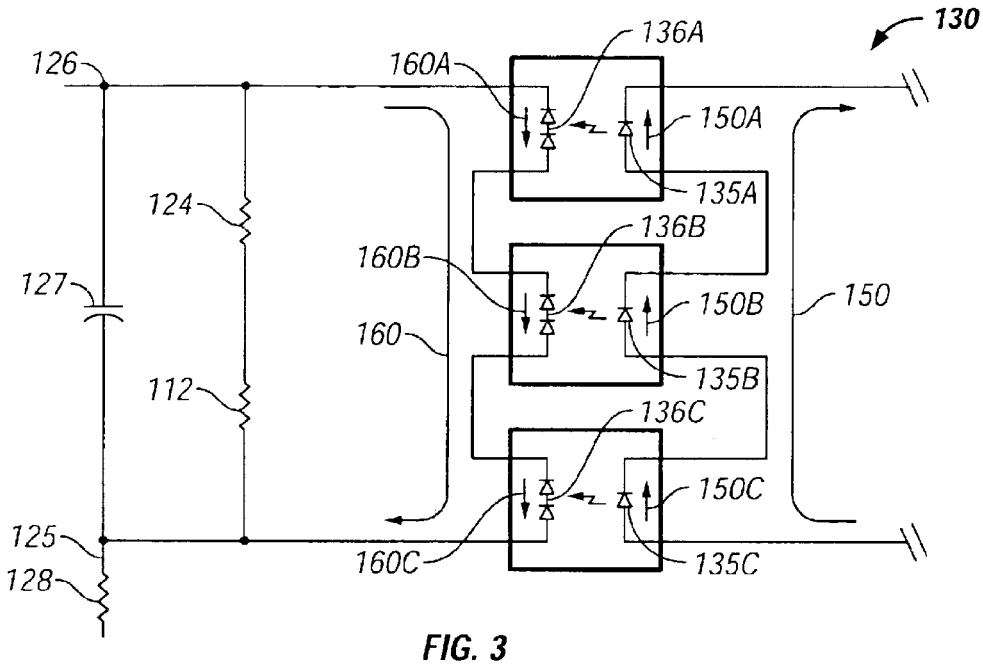
FIG. 3 is a dissected simplified schematic of the electrically isolated controlled circuit of the bias generation circuit of FIG. 2.
Figure 4:
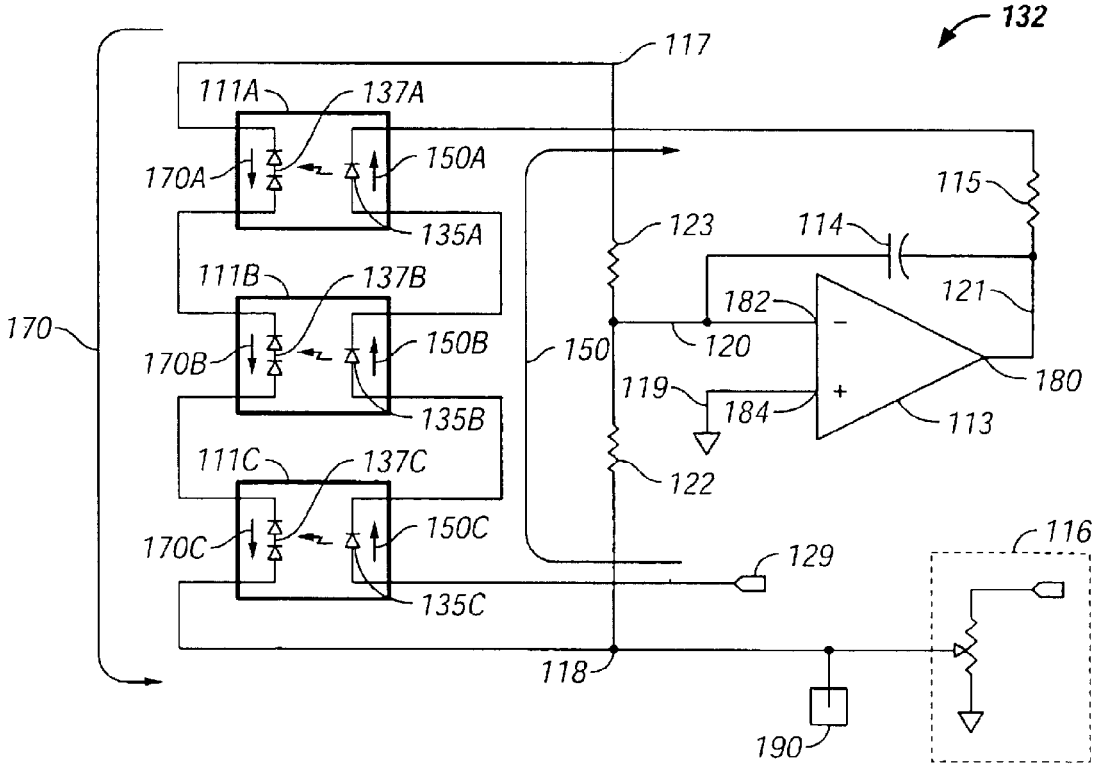
FIG. 4 is a dissected simplified schematic of the electrically isolated controlling circuit of the bias generation circuit of FIG. 2.

Referring to FIGS. 2, 3 and 4, optically coupled power source 111A is comprised of light emitting diode 135A, and photovoltaic diodes 136A and 137A. Light emitting diode 135A is disposed in such a way that the light from light emitting diode 135A impinges equally on controlled photovoltaic diode set 136A and controlling photovoltaic diode set 137A. Optically coupled power source 111B is comprises of light emitting diode 135B, and photovoltaic diodes 136B and 137B. Optically coupled power source 111C is comprised of light emitting diode 135C, and photovoltaic diodes 136C and 137C.

Optically coupled power sources 111B and 111C are configured similarly to optically coupled power source 111A, such that light emitting diode 135B is disposed in such a way that the light from light emitting diode 135B impinges equally on controlled photovoltaic diode set 136B and controlling photovoltaic diode set 137B, and light emitting diode 135C is disposed in such a way that the light from light emitting diode 135C impinges equally on controlled photovoltaic diode set 136C and controlling photovltaic diode set 137C.

Light emitting diodes 135A, 135B and 135C are connected in series. The anode end of light emitting diode 135C is connected to ground 129, and the cathode end of light emitting diode 135C is connected to the anode end of the next light emitting diode 135B in series. The cathode end of light emitting diode 135B is connected to the anode end of the next light emitting diode 135A in series. The cathode end of light emitting diode 135B is connected to resistor 115, which is then connected to output 180 of operational amplifier 113.

Controlled photovoltaic diode sets 136A, 136B and 136C generate an electrically isolated controlled current 160, which is essentially equivalent to an electrically isolated controlling current 170 generated by respective, controlling photovoltaic diode sets 137A, 137B and 137C.

Controlled photovoltaic diode sets 136A, 136B and 136C are connected in series into controlled circuit 130. Output node 125 connects to the anode end of controlled photovoltaic diode set 136C. The cathode end of photovoltaic diode set 136C connects to the anode end of the next photovoltaic diode set 136B in series. The cathode end of photovoltaic diode set 136B connects to the anode end of the next photovoltaic diode set 136A in series. Input node 126 connects to the cathode end of controlled photovoltaic diode set 136A.

Also connected between input node 126 and output node 125, parallel with controlled photovoltaic diode sets 136A, 136B and 136C are resistors 124 and 112. In the exemplary embodiment, resistors 124 and 112 possess equivalent resistance.

Also connected between input node 126 and output node 125, parallel with controlled photovoltaic diode sets 136A, 136B and 136C, and resistors 124 and 112, is capacitor 127. One operational side of capacitor 127 is connected to input node 126 and the other operational side of capacitor 127 is connected to output node 125. In the exemplary embodiment, resistor 128 is also connected to node output 125 intermediate the device intended to use the generated bias voltage.

Controlling photovoltaic diode sets 137A, 137B and 137C are connected into controlling circuit 132. Positive output node 118 connects to the anode end of controlling photovoltaic diode set 137C. The cathode end of photovoltaic diode set 137C connects to the anode end of the next photovoltaic diode set 137B in series. The cathode end of photovoltaic diode set 137B connects to the anode end of the next photovoltaic diode set 137A in series. The cathode end of controlling photovoltaic diode set 137A connects to node 117.

Positive output node 118 is also connected to a reference voltage source 116. In the exemplary embodiment, reference voltage source 16 is set to +10 volts. Node 117 also connects to resistor 123, which in turn connects to node 120. Resistor 122 connects to node 120 on one end and to node 118 on the other. Resistors 123 and resistor 122 possess equivalent resistance.

Non-inverting input 184 of operational amplifier 13 is connected to ground 19. Inverting input 182 of operational amplifier 113 is connected to node 120 and to the one operational side of capacitor 114. Output 180 of operational amplifier 113 is connected to node 121, which also connects to resistor 115 and the other operational side of capacitor 114.

Introducing drive current 150, as sub-currents 150A, 150B and 150C, through light emitting diodes 135A, 135B and 135C, respectively, activates circuit 100. The light emitted by light emitting diodes 135A, 135B and 135C, induces currents 160A, 160B and 160C, in photovoltaic diodes 136A, 136B and 136C, respectively, which in series form driven output current 160. At the same time the light emitted by light emitting diodes 135A, 135B and 135C, induces currents 170A, 170B and 170C, in photovoltaic diodes 137A, 137B and 137C, respectively, which in series form driven feedback current 170.

Under stable operating conditions, driven output current 160, generated by photovoltaic diode sets 136A, 136B and 136C, is essentially equivalent to driven feedback current 170, generated by photovoltaic diode sets 137A, 137B and 137C. Additionally, the voltage across resistors 112 and 124 is equal to the voltage across resistors 122 and 123; the voltage at node 117 is equal in magnitude and opposite in sign to the voltage at node 118; and the voltage at node 120, (since the resistors 112 and 123, are of equal value) is essentially zero. The electrically isolated voltage source at nodes 125 and 126 is used as the desired generated bias.

Bias generation circuit 100 is configured to seek a stable condition. Since controlled circuit 130 and controlling circuit 132 are subject to the same conditions of loading—e.g., illumination, temperature, etc.—the voltage difference between nodes 125 and 126 will be the same as the voltage difference between nodes 118 and 117.

The foregoing disclosure and description of the invention is illustrative and explanatory thereof. Various changes in the details of the illustrated construction may be made within the scope of the appended claims without departing from the spirit of the invention. The present invention should only be limited by the following claims and their legal equivalents.

We claim:

1. An electrical circuit for producing a stable voltage at a circuit output, comprising:

an operational amplifier;

said amplifier having an inverting input node and an amplifier output node;

at least one light-emitting diode in series electrically connected to said amplifier output node;

at least two forward-biased photovoltaic diodes arranged in electronically isolated diode pairs;

each of said isolated diode pairs positioned in uniform operational proximity to one of said at least one light-emitting diode;

each isolated diode pairs comprised of a first diode set and a second diode set;

each of said first diode set electrically connected in series in a chargeable closed circuit to said inverting input node; and each of said second diode set electrically connected in series to said circuit output.

2. The electrical circuit in claim 1 further comprising:

a reference voltage source;

said first diode set connected to said reference voltage source.

3. The electrical circuit in claim 2 where:

said reference voltage source providing an adjustable voltage.

4. The electrical circuit in claim 1 further comprising:

a capacitor electrically connected to said amplifier output node and said inverting input node.

5. The electrical circuit in claim 4 further comprising:

said first diode set having a number of individual diodes in series; and said inverting input node connected to first diode set intermediate an equal number of said individual diodes.

6. The electrical circuit in claim 1 further comprising:

a balanced pair of resistors connected in parallel with said first diode set; and said inverting input node connected to said first diode set intermediate said balanced pair of resistors.

7. The electrical circuit in claim 1 further comprising:

equivalent resistance connected in parallel with each of said first diode set and said second diode set.

8. The electrical circuit in claim 1 further comprising:

resistance connected intermediate said amplifier output node and said at least one light-emitting diode.

9. A method for producing a stable voltage comprising:

initiating a drive current through a drive circuit, said drive circuit containing an operational amplifier, said amplifier having an inverting input node and an amplifier output node, at least one light-emitting diode in series and said at least one light-emitting diode electrically receiving said drive current from said amplifier output node;

inducing at least two electrically isolated driven currents in at least one electrically isolated controlled circuit and at least one electrically isolated controlling circuit, said controlled circuit having at least one forward-biased photovoltaic diode, each said at least one photovoltaic diode arranged in electrically isolated pairs with at least one photovoltaic diode of said controlling circuit each, each said at least one photovoltaic diode of each of said isolated diode pairs positioned in uniform operational proximity to one of said at least one light-emitting diode, each isolated diode pairs comprises of a controlling diode and a controlled diode, each of said controlling diodes electrically connected in series in a chargeable closed circuit to said inverting input node and each of said controlled diodes electrically connected in series to said circuit output;

stabilizing said electrically isolated driven current of each said at least one electrically isolated controlled circuit by adjusting said driven current with said drive current corrected by said operational amplifier for a correcting signal at said inverting input node.

10. The method of claim 9 wherein:

said controlling diodes generate said correcting signal to said inverting input node.

11. The method of claim 9 wherein:

said correcting signal is 0 when circuit is in a stable condition.

12. An electrical circuit for producing a stable voltage at a circuit output, comprising:

an operational amplifier;

said amplifier having an inverting input node and an amplifier output node;

at least one light-emitting diode in series electrically connected to said amplifier output node;

at least two photovoltaic diodes arranged in electronically isolated diode pairs;

each of said isolated diode pairs positioned in uniform operational proximity to one of said at least one light-emitting diode;

each isolated diode pair comprised of a first diode set and a second diode set;

a balanced pair of resistors connected in parallel with said first diode set;

a potentiometer connected to said first diode set intermediate said balanced pair of resistors;

said inverting input node connected to said potentiometer;

each of said second diode set electrically connected in series to said circuit output.

13. An electrical circuit for use with a chromatographic ionization detector for producing a stable voltage at a circuit output, comprising:

an operational amplifier;

said amplifier having an inverting input node and an amplifier output node;

at least one light-emitting diode in series electrically connected to said amplifier output node;

at least two forward-biased photovoltaic diodes arranged in electronically isolated diode pairs;

each of said isolated diode pairs positioned in uniform operational proximity to one of said at least one light-emitting diode;

each isolated diode pairs comprised of a first diode set and a second diode set;

each of said first diode set electrically connected in series in a chargeable closed circuit to said inverting input node; and each of said second diode set electrically connected in series to said circuit output.

14. The electrical circuit for use with a chromatographic ionization detector in claim 13 further comprising:

a reference voltage source;

said first diode set connected to said reference voltage source.

15. The electrical circuit for use with a chromatographic ionization detector in claim 14 where:

said reference voltage source providing an adjustable voltage.

16. The electrical circuit for use with a chromatographic ionization detector in claim 13 further comprising:

a capacitor electrically connected to said amplifier output node and said inverting input node.

17. The electrical circuit for use with a chromatographic ionization detector in claim 16 further comprising:

said first diode set having a number of individual diodes in series; and said inverting input node connected to first diode set intermediate an equal number of said individual diodes.

18. The electrical circuit for use with a chromatographic ionization detector in claim 13 further comprising:

a balanced pair of resistors connected in parallel with said first diode set; and said inverting input node connected to said first diode set intermediate said balanced pair of resistors.

19. The electrical circuit for use with a chromatographic ionization detector in claim 13 further comprising:

equivalent resistance connected in parallel with each of said first diode set and said second diode set.

20. The electrical circuit for use with a chromatographic ionization detector in claim 13 further comprising:

resistance connected intermediate said amplifier output node and said at least one light-emitting diode.

21. A method for producing a stable voltage for use with a chromatographic ionization detector comprising:

initiating a drive current through a drive circuit, said drive circuit containing an operational amplifier, said amplifier having an inverting input node and an amplifier output node, at least one light-emitting diode in series and said at least one light-emitting diode electrically receiving said drive current from said amplifier output node;

inducing at least two electrically isolated driven currents in at least one electrically isolated controlled circuit and at least one electrically isolated controlling circuit, said controlled circuit having at least one forward-biased photovoltaic diode, each said at least one photovoltaic diode arranged in electrically isolated pairs with at least one forward-biased photovoltaic diode of said controlling circuit, each said at least one photovoltaic diode of each of said isolated diode pairs positioned in uniform operational proximity to one of said at least one light-emitting diode, each isolated diode pairs comprised of a controlling diode and a controlled diode, each of said controlling diodes electrically connected in series in a chargeable closed circuit to said inverting input node and each of said controlled diodes electrically connected in series to said circuit output;

stabilizing said electrically isolated driven current of each said at least one electrically isolated controlled circuit by adjusting said driven current with said drive current corrected by said operational amplifier for a correcting signal at said inverting input node.

22. The method of claim 21 wherein:

said controlling diode generate said correcting signal to said inverting input node.

23. The method of claim 21 wherein:

said correcting signal is 0 when circuit is in a stable condition.

24. An electrical circuit for use with a chromatographic ionization detector for producing a stable voltage at a circuit output, comprising:

an operational amplifier;

said amplifier having an inverting input node and an amplifier output node;

at least one light-emitting diode in series electrically connected to said amplifier output node;

at least two photovoltaic diodes arranged in electronically isolated diode pairs;

each of said isolated diode pairs positioned in uniform proximity to one of said at least one light-emitting diode;

each isolated diode pair comprised of a first diode set and a second diode set;

a balanced pair of resistors connected in parallel with said first diode set;

a potentiometer connected to said first diode set intermediate said balanced pair of resistors;

said inverting input node connected to said potentiometer;

each of said second diode set electrically connected in series to said circuit output.

* * * * *